US005411118A

United States Patent [19]

Thangavelu et al.

[11] Patent Number: 5,411,118

[45] Date of Patent: May 2, 1995

[54] ARRIVAL TIME DETERMINATION FOR PASSENGERS BOARDING AN ELEVATOR CAR

[75] Inventors: Kandasamy Thangavelu, Avon; Venkataramana S. Pullela, North Granby, both of Conn.

[73] Assignee: Otis Elevator Company, Farmington, Conn.

[21] Appl. No.: 41,145

[22] Filed: Mar. 30, 1993

Related U.S. Application Data

[63] Continuation of Ser. No. 659,108, Feb. 21, 1991, abandoned.

[51] Int. Cl.[6] ..... B66B 1/18

[52] U.S. Cl. ..... 187/392; 187/382

[58] Field of Search ..... 187/382, 380, 387, 392

[56] References Cited

U.S. PATENT DOCUMENTS

| | | | |
|---|---|---|---|
| 4,363,381 | 12/1982 | Bittar | 187/29 R |
| 4,760,896 | 8/1988 | Yamaguchi | 187/124 |
| 4,799,243 | 1/1989 | Zepke | 377/6 |
| 4,802,557 | 2/1989 | Umeda et al. | 187/127 |
| 4,838,384 | 6/1989 | Thangavelu | 187/125 |
| 4,846,311 | 7/1989 | Thangavelu | 187/125 |
| 4,947,965 | 8/1990 | Kuzunuki et al. | 187/127 |
| 5,022,497 | 6/1991 | Thangavelu | 187/124 |
| 5,024,295 | 6/1991 | Thangavelu | 187/125 |
| 5,202,540 | 4/1993 | Auer et al. | 187/101 |

*Primary Examiner*—Thomas M. Dougherty
*Assistant Examiner*—Robert Nappi

[57] ABSTRACT

The present invention is directed to determining an arrival time for each of the passengers boarding an elevator car. Where the elevator car stops at a floor in response to a hall call request, the arrival time of the passengers which boarded the elevator car is preferably determined based the time period between when the hall call was registered and when the elevator car door closed. Where the elevator car stops at a floor in response to a car call registered within the elevator, the arrival time of the passengers which boarded the elevator car is preferably determined based on the time period between when the elevator stopped at the floor and when the elevator car door closed. Alternatively, the time period between when the elevator car door opened and when the elevator car door closed can be used. In the preferred embodiment, the first passenger is assumed to have an arrival time corresponding to the beginning of the time period. If more than one passenger boarded the elevator, the passengers are assumed to have arrived in a distributed fashion over this time period.

9 Claims, 3 Drawing Sheets

ARRIVAL TIME DETERMINATION FOR PASSENGERS BOARDING AN ELEVATOR CAR

This application is a continuation of U.S. patent application Ser. No. 07/659,108, filed Feb. 21, 1991, now abandoned.

BACKGROUND OF THE INVENTION

1. Technical Field

The present invention is directed to determining an arrival time of passengers boarding an elevator car. More particularly, the present invention is directed to determining an arrival time for each of the passengers boarding an elevator car.

As used herein, the term "arrival time" means the time at which a passenger arrives at an elevator, or the area in which the elevators are located, for service in a predetermined direction.

2. Background Information

In a building having a plurality of floors, each floor typically has a set of buttons located in the hallway at or near the elevator(s). These buttons, commonly referred to as hall call buttons, allow a user to request elevator car service in-a predetermined direction, e.g., up or down. Additionally, the interior of an elevator car is generally equipped with a plurality of buttons, commonly referred to as car call buttons, which allow users to request service to specific floors.

In simplified terms, an elevator control system, also referred to in the art as a dispatching system, monitors the status of the hall call buttons at the floors and car call buttons in the elevators, dispatching an elevator car to the floors in response to hall call and/or car call button registration. The door on the arriving elevator car opens, allowing passengers to board and/or deboard the car at the floor, and then closes.

Elevator dispatching systems for controlling the assignment of elevator cars in a building are well known in the art. In some of these systems, historic information regarding passenger traffic flow is recorded and used to predict future traffic patterns, yielding more efficient service. See, e.g., U.S. Pat. Nos. 4,838,384, 4,846,311 5,022,497 and 5,024,295 all to the same inventors, and owned by the same assignee, as the present invention, herein incorporated by reference.

In such prior an systems having traffic prediction, passenger traffic flow, e.g., the number of passengers boarding an elevator at a floor in response to a hall call, is typically determined for a plurality of time intervals, typically 3 to 5 minutes each. Passenger traffic flow data collected during these time intervals over the course of a specific day, as well as over a plurality of days preceding the specific day, is used to predict the traffic flow.

The change in the elevator car load due to passengers boarding and deboarding is determined and converted into passenger boarding counts. Alternatively, passenger boarding counts are determined by a people sensing/counting arrangement. See, e.g., U.S. Pat. No. 4,799,243 issued to Zepke and assigned to the same assignee as the present invention. In the prior art, the passenger boarding counts are associated with the time interval during which the elevator car doors closed.

As known in the art, the time delay between hall call registration and an elevator car's arrival in response to the hall call is a function of several factors, e.g., traffic conditions, the number of elevators in service, the dispatching algorithm utilized, and en route delays caused by intermediary hall calls and/or car calls. Because of this time delay, it is possible that passengers will register a hall call during one time interval but will be serviced by an elevator car during a subsequent time interval. In these situations, prior art systems which group all boarded passengers in the time interval during which the elevator door is closed inaccurately portray passenger arrival times.

By associating passenger boarding counts with the time interval during which the elevator car door is closed, passengers appear to arrive in groups, at the time when the elevator car door is closed. Because passengers arrive in a more distributed fashion over the time period between hall call registration and when the elevator car door is closed, predictions based on group passenger arrival when the elevator car door closes are inherently inaccurate.

SUMMARY OF THE INVENTION

Accordingly, it is an object of the present invention to more accurately determine the arrival time of passengers boarding an elevator car in response to a hall call.

It is a further object of the present invention to determine an arrival time for each of the passengers boarding an elevator car in response to a hall call.

According to the invention, when an elevator car stops at the floor in response to a hall call request, the arrival time of the passengers which board the elevator car is preferably determined based on the number of passengers which board the elevator car and the time period between when the hall call was registered and when the elevator car door closed.

When the elevator car stops at a floor other than in response to a hall call request, e.g., in response to a car call registered within the elevator, the arrival time of the passengers which board the elevator car is preferably determined based on the number of passengers which board and the time period between when the elevator stopped at the floor and when the elevator car door closed. Alternatively, the time period between when the elevator car door opened and when the elevator car door closed can be used.

In the preferred embodiment, the first passenger is assumed to have an arrival time corresponding to the beginning of the time period, e.g., the time at which the hall call button was registered, the time at which the elevator car stopped at the floor, or the time at which the elevator door opened. If more than one passenger boarded the elevator, the passengers are assumed to have arrived in a distributed fashion over this time period.

Three possible passenger arrival schemes are taken into account: the last passenger arrived immediately prior to elevator door closure and was thus able to board; a passenger arrived immediately after the elevator door closed and was not able to board; and, the elevator door closed halfway between arriving passengers.

After an arrival time for each of the passengers has been determined, the elevator control system preferably stores these passenger boarding counts in the appropriate time interval corresponding to their determined time of arrival. In situations where passengers initiate a hall call during one time interval and are serviced by an elevator car during a subsequent time interval, the present invention more realistically determines passenger arrivals than the prior art. Thus, traffic flow predictions, which are based on passenger arrival times, will be more accurate than those .predictions as set forth in the prior art.

DESCRIPTION OF THE PREFERRED EMBODIMENT(S)

In a building having a plurality of floors, each floor typically has a set of buttons located in the hallway at or near the elevators. These buttons, commonly referred to as hall call buttons, allow a user to request elevator car service in a predetermined direction, e.g., up or down. In addition, the interior of an elevator car is generally equipped with a plurality of buttons, commonly referred to as car call buttons, which allow users to request service to specific floors.

An elevator control system, also referred to in the art as a dispatching system, monitors the status of the hall call buttons at the floors, dispatching an elevator car to the floors in response to hall call and/or car call button registration. The door on the arriving elevator car opens, allowing passengers to board and/or deboard the car at the floor, and then closes.

Figure 1:
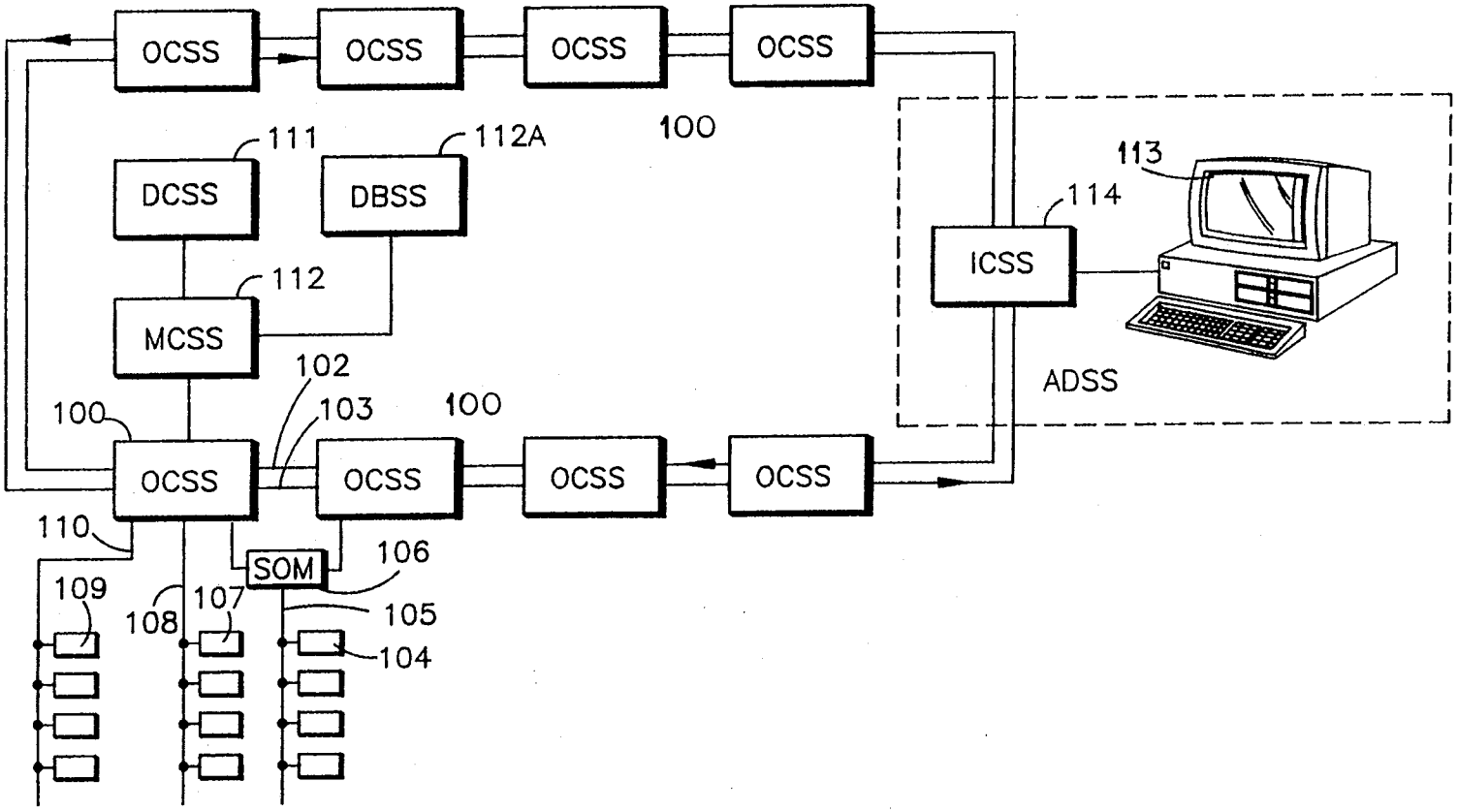
fig. 1 prior art
FIG. 1 depicts an exemplary elevator control system.

An exemplary elevator control system is shown with reference to FIG. 1. It is to be understood, however, that the present invention can be used with any other elevator control system, including, but not limited to, those described in U.S. Pat. Nos. 4,363,381 to Bittar, 5,202,510, to Auer et al., all owned by the same assignee as the present invention and which are herein incorporated by reference.

Turning now to FIG. 1, an exemplary elevator control system is shown. Each elevator car has an operational control subsystem (OCSS) 100, 101 which communicates to each other OCSS in a ring communication system via lines 102, 103. It is to be understood that each OCSS has various circuitry connected thereto. However, for the sake of simplicity, the circuitry associated with only one OCSS 101 is described.

Hall call buttons and their associated lights and circuitry (not shown) are connected to the OCSS 101 via remote stations 104, remote serial communication link 105 and switch-over module 106. Car buttons and their associated lights and circuitry (not shown) are connected to an OCSS via remote stations 107 and remote serial communication link 108. Hall fixtures, indicating e.g. the direction of travel of the car which is to stop and/or which set of doors will be opened to accommodate the car which is to stop, and their associated lights and circuitry (not shown) are connected to an OCSS via remote station 109 and remote serial communication link 110.

The operation of the elevator car door is controlled by door control subsystem (DCSS) 111. The movement of the elevator car is controlled by motion control subsystem (MCSS) 112, which operates in conjunction with drive and brake subsystem (DBSS) 112A. Dispatching is executed by the OCSS under the supervisory control of advanced dispatching subsystem (ADSS) 113, communicating via information control subsystem (ICSS) 114.

In the preferred embodiment, the DCSS also determines the load of the elevator car, the load being convened into passenger boarding and/or deboarding counts by the MCSS. This information is sent to the ADSS for recordation and prediction of traffic flow in order to increase the efficiency of elevator service. Alternatively, passenger boarding and/or deboarding counts can be determined by a people sensing/counting arrangement as shown, e.g., in U.S. Pat. No. 4,799,243 issued to Zepke, hereby incorporated by reference.

Figure 2:
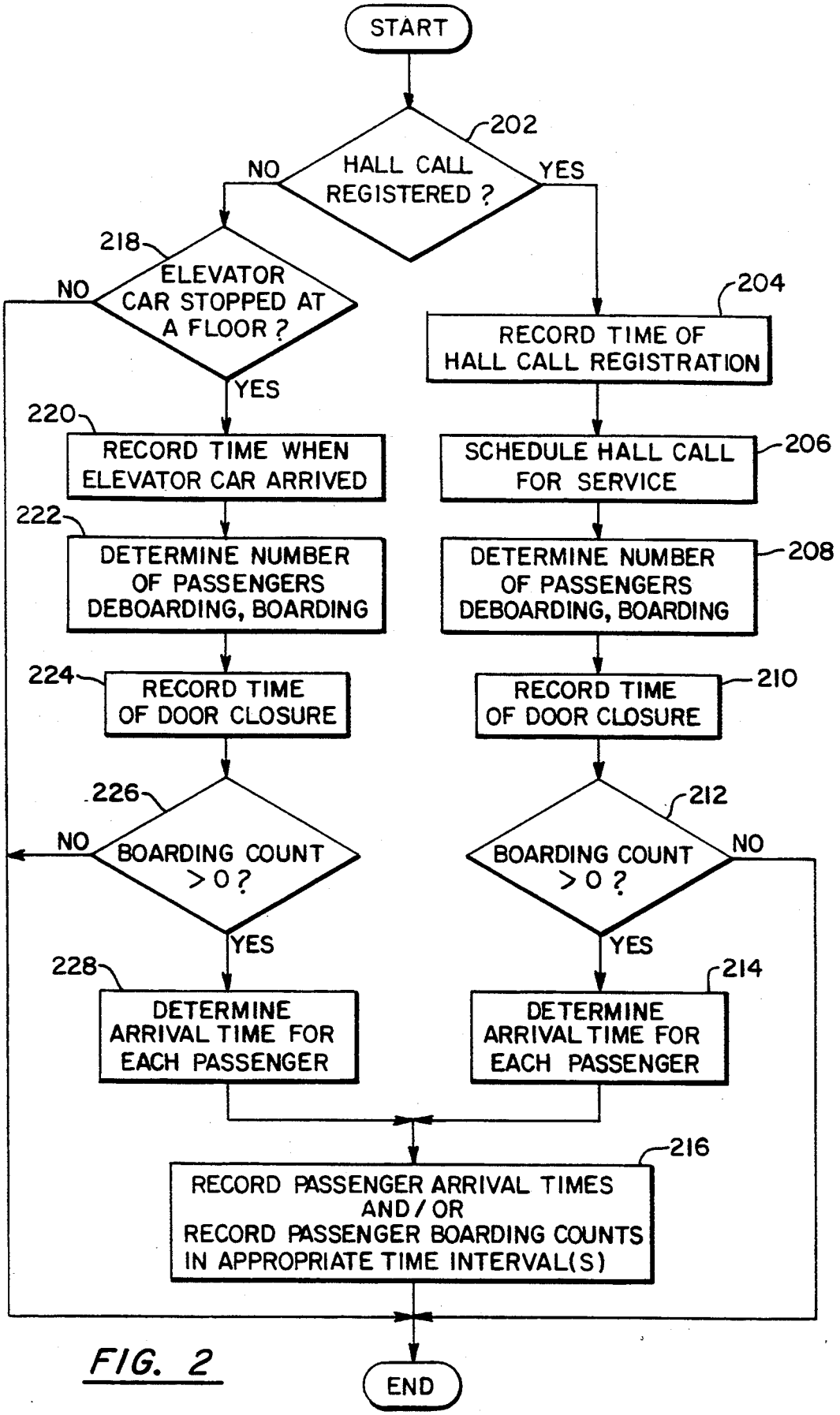
FIG. 2 illustrates a preferred embodiment for determining an arrival time for each of the passengers boarding an elevator car.

Turning now to FIG. 2, a preferred embodiment for determining an arrival time for each of the passengers boarding an elevator car is illustrated. It is to be understood that the following discussion is applicable for all elevator cars, and for all elevator car stops, in both the up and the down direction.

At step 202, an elevator control system, also referred to in the art as a dispatching system, determines whether a hall call has been registered, and if so, records the time at which the hall call was registered at step 204. The system assigns the registered hall call to a car for service at step 206, according to any one of a number of well known dispatching schemes.

The elevator car which is dispatched, upon arriving at the floor which registered the hall call, opens its door to allow passengers to deboard there from and/or board at the floor, closing its door after a predetermined time.

At step 208, the system determines the number of passengers which deboarded and/or boarded the elevator car. In the preferred embodiment, it is assumed that deboarding passengers will precede boarding passengers. Thus, in the preferred embodiment, the minimum load of the elevator car is sensed, compared with the load of the elevator car just prior to stopping at the floor, and used to determine the number of passengers which deboarded. The load of the elevator car just after the doors are closed is also sensed, compared with the minimum load, and used to determine the number of passengers which boarded. Various methods are known in the art for determining passenger counts from load data, e.g., assuming an average weight of 150 pounds per passenger. The time at which the door closed is recorded at step 210.

At step 212, if at least one passenger was determined to have boarded, the arrival time for each passenger is determined at step 214. In the preferred embodiment, the arrival time for the passengers which boarded is determined by distributing their arrival times, in a linear fashion, over the time period between when the hall call was registered and when the elevator car door closed. The arrival time of the Nth passenger is thus determined according to the following equation:

$$\text{Arrival Time}_N = T_{hcr} + (N-1)\Delta t$$

where:

$T_{hcr}$ represents the time of hall call registration; and $$\Delta t = \frac{\text{time period between hall call registration and door closure}}{\text{number of passengers which boarded} - x}.$$

The value of x is determined based on an overall assumption of how passengers arrived at the elevator car. In the preferred embodiment, three possible passenger arrival schemes are taken into account: the last passenger arrived immediately prior to elevator door closure and was thus able to board; a passenger arrived immediately after the elevator door closed and was not able to board; and, the elevator door closed halfway between arriving passengers.

Figure 3A:
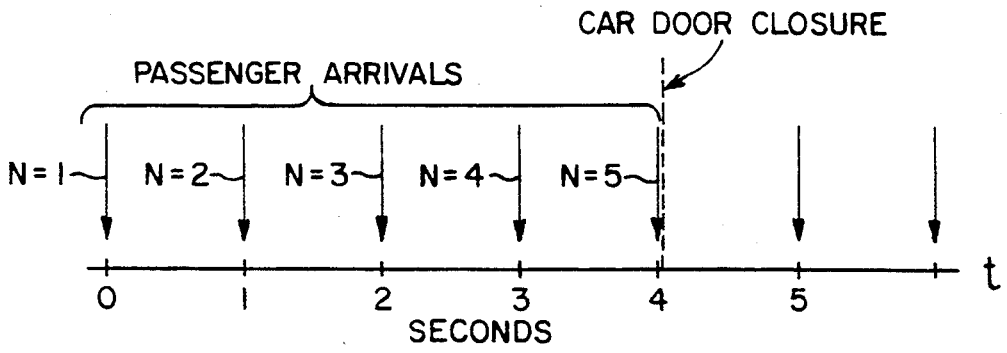
FIGS. 3A, 3B and 3C depicts three possible scenarios of passenger arrivals, relative to elevator car door closure.

If it is assumed that the last passenger arrived immediately prior to elevator door closure and was thus able to board, x is preferably set equal to one (1). This situation is graphically depicted as shown with reference to FIG. 3A, with the time axis being relative to hall call registration. Thus, if the time period is 4 seconds and 5 passengers boarded, they each arrived at one second intervals, with the last passenger arriving 4 seconds after the hall call was registered, which also corresponds to the time of door closure.

Figure 3B:
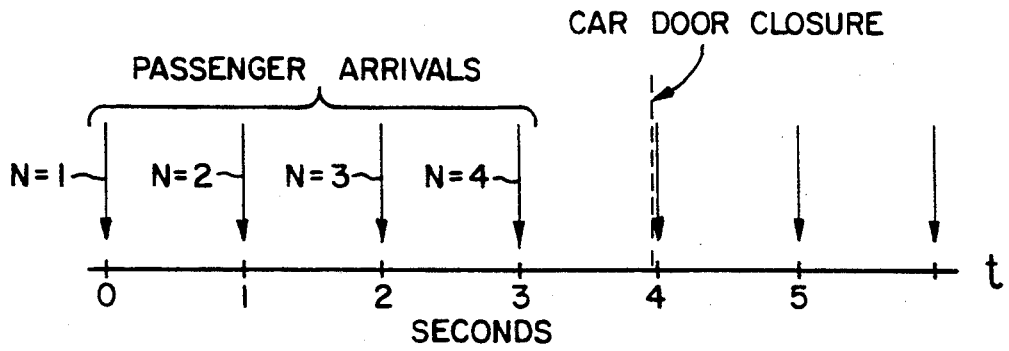

If it is assumed that a passenger arrived immediately after the elevator door closed and was not able to board, x is preferably set equal to zero (0). This situation is graphically depicted as shown with reference to FIG. 3B, with the time axis being relative to hall call registration. Thus, if the time period is 4 seconds and 4 passengers boarded, they each arrived at one second intervals, with tile last passenger arriving 3 seconds after the hall call was registered.

Figure 3C:
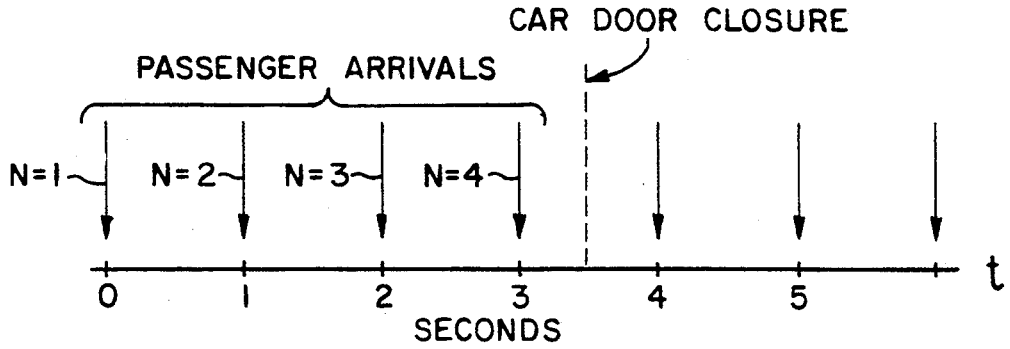

If it is assumed that tile elevator door closed halfway between arriving passengers, x is preferably set equal to 0.5 with the last passenger arriving ($\Delta t-0.5$) seconds before door closure. This situation is graphically depicted as shown with reference to FIG. 3C, with the time axis being relative to hall call registration. Thus, if tile time period is 3.5 seconds and 4 passengers boarded, they each arrived at one second intervals, with the last passenger arriving 3 seconds after the hall call was registered, which also corresponds to 0.5 seconds before door closure.

At step 216, the individual passenger arrival times determined for each passenger are recorded. As discussed above, passenger traffic flow, e.g., the number of passengers boarding an elevator at a floor in response to a hall call, is typically determined during a plurality of time intervals, typically 3 to 5 minutes each. Passenger traffic flow data collected during these time intervals over the course of a specific day, as well as over a plurality of days preceding the specific day, is used to predict future traffic flow. Thus, in addition to recording the individual passenger arrival times determined for each passenger, but preferably alternatively thereto, passenger boarding counts are cumulated and recorded in the appropriate time intervals, based on their respective times of arrival, at step 216.

At step 218, if a hall call was not registered but an elevator car stopped at a floor, e.g., in response to a car call registered within the elevator car, the time at which the elevator car arrived at the floor is recorded at step 220. Alternatively, the time at which the elevator door opened could be recorded at step 220.

The elevator car opens its door to allow passengers to deboard and/or board at the floor, determines at step 222 the number of passengers which deboarded and/or borded and closes its door after a predetermined time, recording the time at which the door closed at step 224.

The system determines the number of passengers which deboarded and/or boarded the elevator car at step 222 in the manner set forth with reference to step 208. At step 226, if at least one passenger was determined to have boarded, the arrival time for each passenger is determined at step 228 in the manner set forth with reference to step 214, with minor modifications based on the beginning of the time period.

Where the time at which the elevator car arrived was recorded at step 220, the arrival time for each passenger is preferably distributed over the time period between when the elevator car arrived and when the door of the elevator car closed, with the arrival time of the first passenger set equal to the time when the elevator car arrived. The arrival time of the Nth passenger is thus determined according to the following equation:

$$\text{Arrival Time}_N = T_{eca} + (N-1)\Delta t$$

where:

$T_{eca}$ represents the time when the elevator car arrived; and $$\Delta t = \frac{\text{time period between when elevator car arrived at the floor and door closure}}{\text{number of passengers which boarded} - x}$$

where x is as described hereinbefore

Alternatively, if the time at which the elevator door opened was recorded at step 220, the arrival time for each passenger is preferably distributed over the time period between when the elevator car door opened and when the elevator car door closed, with the arrival time of the first passenger set equal to the time when the elevator car door opened. The arrival time of the Nth passenger is thus determined according to the following equation:

$$\text{Arrival Time}_N = T_{ecdo} + (N-1)\Delta t$$

where:

$T_{ecdo}$ represents the time when the elevator car door opened; and $$\Delta t = \frac{\text{time period between when elevator car door opened and when car door closed}}{\text{number of passengers which boarded} - x}.$$

At step 216, the passenger arrival times are recorded and/or the passenger boarding counts are cumulated and recorded in the appropriate time intervals, in the manner previously set forth.

The recorded data of passenger boarding counts, as set forth above, finds utility in any and all prediction schemes where passenger arrival data is employed. Applications include, but are not limited to, commencing and/or concluding up-peak and/or down-peak periods of operation, dynamic channeling, dynamic sectoring, and variable frequency of service to various sectors.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What we claim as our invention is:

1. In an elevator car system servicing a building having a plurality of floors, each of the floors having hall call buttons for requesting service in a travel direction, a method of dispatching including determining a unique arrival time for each of the passengers boarding an elevator car at a floor for travel in a direction, comprising:

dispatching an elevator car to a predetermined floor in response to a hall call registered thereat;

opening the elevator car door at the predetermined floor to allow passengers to enter and leave the elevator car;

closing the elevator car door;

determining the number (N) of passengers which boarded the elevator car at the predetermined floor;

determining the time period between when the hall call was registered and when the elevator car door closed;

dividing the time period between when the hall call was registered and when the elevator car door closed into about N predetermined time portions;

determining the time of day of the arrival of the Nth passenger to have boarded the elevator car by adding (N−1) of said predetermined time portions to the time of day when the hall call was registered; and dispatching elevator cars in accordance with a method which uses said time of day of the arrival of the Nth passenger.

2. The method of claim 1, wherein one of said predetermined time portions is determined based on the following equation, where x is a variable between zero and one:

$$\Delta t = \frac{\text{time period between hall call registration and door closure}}{\text{number of passengers which boarded} - x}.$$

3. The method of claim 2, wherein x is equal to 1.

4. The method of claim 2, wherein x is equal to 0.

5. The method of claim 2, wherein x is equal to 0.5.

6. In an elevator car system servicing a building having a plurality of floors, each of said elevator cars having car call buttons and the plurality of floors each having hall call buttons, a method of dispatching including determining a unique arrival time for each of the passengers boarding an elevator car at a floor for travel in a direction, comprising:

dispatching an elevator car to a predetermined floor in response to a car call registered in said car;

opening the elevator car door at the predetermined floor to allow passengers to enter and leave the elevator car;

closing the elevator car door;

determining the number (N) of passengers which boarded the elevator car at the predetermined floor;

determining when the elevator car arrived at the predetermined floor;

dividing the time period between when the elevator car arrived at the predetermined floor and when the elevator car door closed into about N predetermined time portions;

determining the time of day of the arrival of the Nth passenger to have boarded the elevator car by adding (N−1) number of said predetermined time portions to the time of day when the elevator car arrived at the predetermined floor; and dispatching elevator cars in accordance with a method which uses said time of day of the arrival of the Nth passenger.

7. The method of claim 6, wherein one of said predetermined time portions is determined based on the following equation, where x is a variable between zero and one:

$$\Delta t = \frac{\text{time period between when elevator car arrived at the floor and door closure}}{\text{number of passengers which boarded} - x}.$$

8. In an elevator car system servicing a building having a plurality of floors, each elevator car having car call buttons and the plurality of floors having hall call buttons, a method of dispatching including determining a unique arrival time for each of the passengers boarding an elevator car at a floor for travel in a direction, comprising:

dispatching an elevator car to the predetermined floor in response to a car call registered in said car;

opening the elevator car door at the predetermined floor to allow passengers to enter and leave the elevator car;

closing the elevator car door;

determining the number (N) of passengers which boarded the elevator car at the predetermined floor;

determining when the elevator car door opened at the predetermined floor;

dividing the time period between when the elevator car door opened at the predetermined floor and when the elevator car door closed into about N predetermined time portions;

determining the time of day of the arrival of the Nth passenger to have boarded the elevator car by adding (N−1) of said predetermined time portions to the time of day when the elevator car door opened at the predetermined floor; and dispatching elevator cars in accordance with a method which uses said time of day of the arrival of the Nth passenger.

9. The method of claim 8, wherein one of said predetermined time portions is determined based on the following equation, where x is a variable between zero and one:

$$\Delta t = \frac{\text{time period between when elevator car door opened and when car door closed}}{\text{number of passengers which boarded} - x}.$$

* * * * *